United States Patent [19]

Tanaka et al.

[11] 4,391,023

[45] Jul. 5, 1983

[54] BUCKLE ARRANGEMENT FOR SEAT BELTS

[75] Inventors: Kobun Tanaka, Nagoya; Takashi Kawaharazaki, Toyoake, both of Japan

[73] Assignee: Kabushiki Kaisha Tokai Rika Denki Seisakusho, Aichi, Japan

[21] Appl. No.: 226,474

[22] Filed: Jan. 19, 1981

[30] Foreign Application Priority Data

Jan. 23, 1980 [JP] Japan ..... 55-6788[U]

[51] Int. Cl.[3] ..... A44B 11/26

[52] U.S. Cl. ..... 24/230 AL

[58] Field of Search ..... 24/230 R, 230 BC, 230 AK, 24/230 AL

[56] References Cited

U.S. PATENT DOCUMENTS 3,449,800 6/1969 Fisher ..... 24/230 A X
4,004,115 1/1977 Esner ..... 24/230 A X
4,025,992 5/1977 Lindblad ..... 24/230 AL
4,197,619 4/1980 Burleigh ..... 24/230 AL

*Primary Examiner*—Robert P. Swiatek
*Attorney, Agent, or Firm*—Wenderoth, Lind & Ponack

[57] ABSTRACT

An improved buckle arrangement for a seat belt for use in a motor vehicle or the like in which retaining portions provided on a frame of the buckle for retaining a locking member are formed into a plate-like shape, while the face of the retaining portions at the side for contacting the locking member are inclined so that, when a force is applied to a tongue portion of the seat belt in the direction of withdrawal, a component force in a direction for unlocking is produced on the tongue portion member, and thus, the locking may be released by a small operating force, even when the unlocking is effected under the state where the tongue portion is subjected to the force in the direction of withdrawal.

4 Claims, 9 Drawing Figures

BUCKLE ARRANGEMENT FOR SEAT BELTS

BACKGROUND OF THE INVENTION

The present invention generally relates to a fastening device and more particularly, to a buckle arrangement for a seat belt for use in a motor vehicle and the like which is adapted to be locked, with a tongue portion of the seal belt inserted in a frame of the buckle.

Conventionally, in the buckles for seat belts of the above described type, there has been proposed an arrangement in which an engaging opening is formed in one end of a tongue portion connected to the seat belt, while a retaining opening is defined in a predetermined portion of a frame of the buckle, for example, by press work so that, upon insertion of the tongue portion into the frame, a locking member provided on the frame is displaced to a position for simultaneously extending through the engaging opening of the tongue portion and the retaining opening of the frame so as to effect locking of the tongue portion.

In the known arrangement as described above, when a force is applied in a direction to withdraw the tongue portion under the locked state, the peripheral edge of the engaging opening of the tongue portion contacts the locking member, with simultaneous engagement of the locking member with the peripheral edge of the retaining opening for preventing the tongue portion from coming out. Accordingly, there has been such a problem that, when it is attempted unlock the tongue portion under the state where the tongue portion is subjected to a force in the direction of withdrawal thereof, the releasing is not readily effected due to frictional resistance between the locking member and the peripheral edge of the retaining opening. Moreover, since the engaging opening is formed by blanking of a sheet material, the peripheral edge thereof is generally rough with an increased frictional resistance, thus requiring a large force to effect the unlocking.

SUMMARY OF THE INVENTION

Accordingly, an essential object of the present invention is to provide an improved buckle arrangement for a seat belt for use in a motor vehicle or the like in which retaining portions provided on a frame of the buckle for retaining a locking member are formed into a plate-like shape, while the faces of the retaining portions at the side for contacting the locking member are inclined so that, when a force is applied to a tongue portion of the seat belt in the direction of withdrawal thereof, a component force in a direction for unlocking the tongue portion is produced on the locking member, and thus, the tongue portion may be released by a small operating force, even when the unlocking is effected under the state where the tongue portion is subjected to the force in the direction of withdrawal thereof.

Another important object of the present invention is to provide an improved buckle arrangement for a seat belt of the above described type which is simple in construction and accurate in functioning, and can be readily manufactured on a large scale at low cost.

In accomplishing these and other objects, according to one preferred embodiment of the present invention, there is provided a buckle arrangement for a seat belt including a frame member, and a locking member movably provided on the frame member so as to lock a tongue portion of a seat belt upon insertion of the tongue portion into the frame member and to release the tongue portion when the locking member is moved in a direction of lock releasing or unlocking by an operating member of the buckle arrangement, and further comprising engaging means formed at an inserting end of the tongue portion for engagement with the locking member, and retaining means of plate-like configuration provided on the frame member for retaining the locking member. The retaining means is so inclined at the plate-like surface thereof as to exert a component force in a direction for unlocking onto the locking member when a force in a direction of withdrawal of the tongue portion is applied to the tongue portion.

By the arrangement according to the present invention as described above, an improved buckle arrangement for a seat belt capable of efficiently locking and unlocking has been advantageously presented, with substantial elimination of disadvantages inherent in the conventional arrangement of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
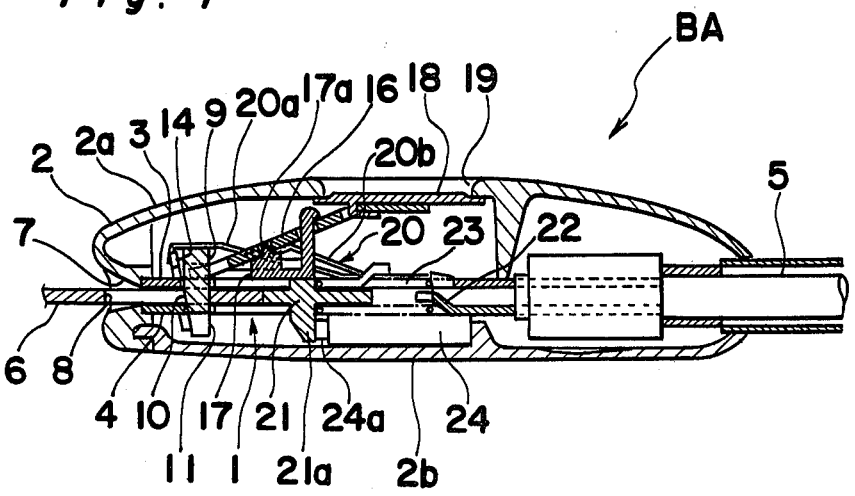
FIG. 1 is a side sectional view of a buckle arrangement for a seat belt according to one preferred embodiment of the present invention.
Figure 2:
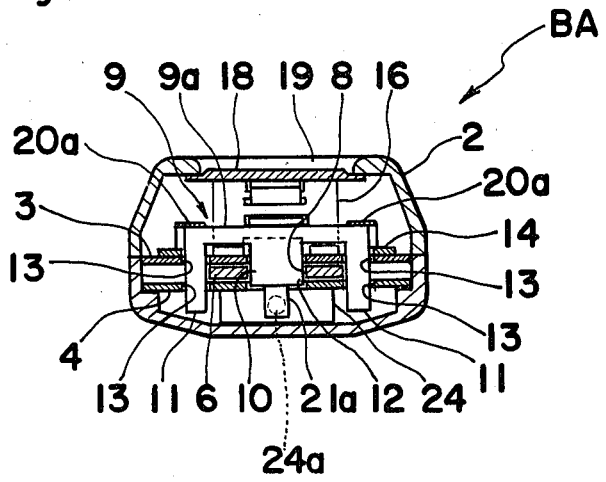
FIG. 2 is a front sectional view of the buckle arrangement of FIG. 1.
Figure 3:
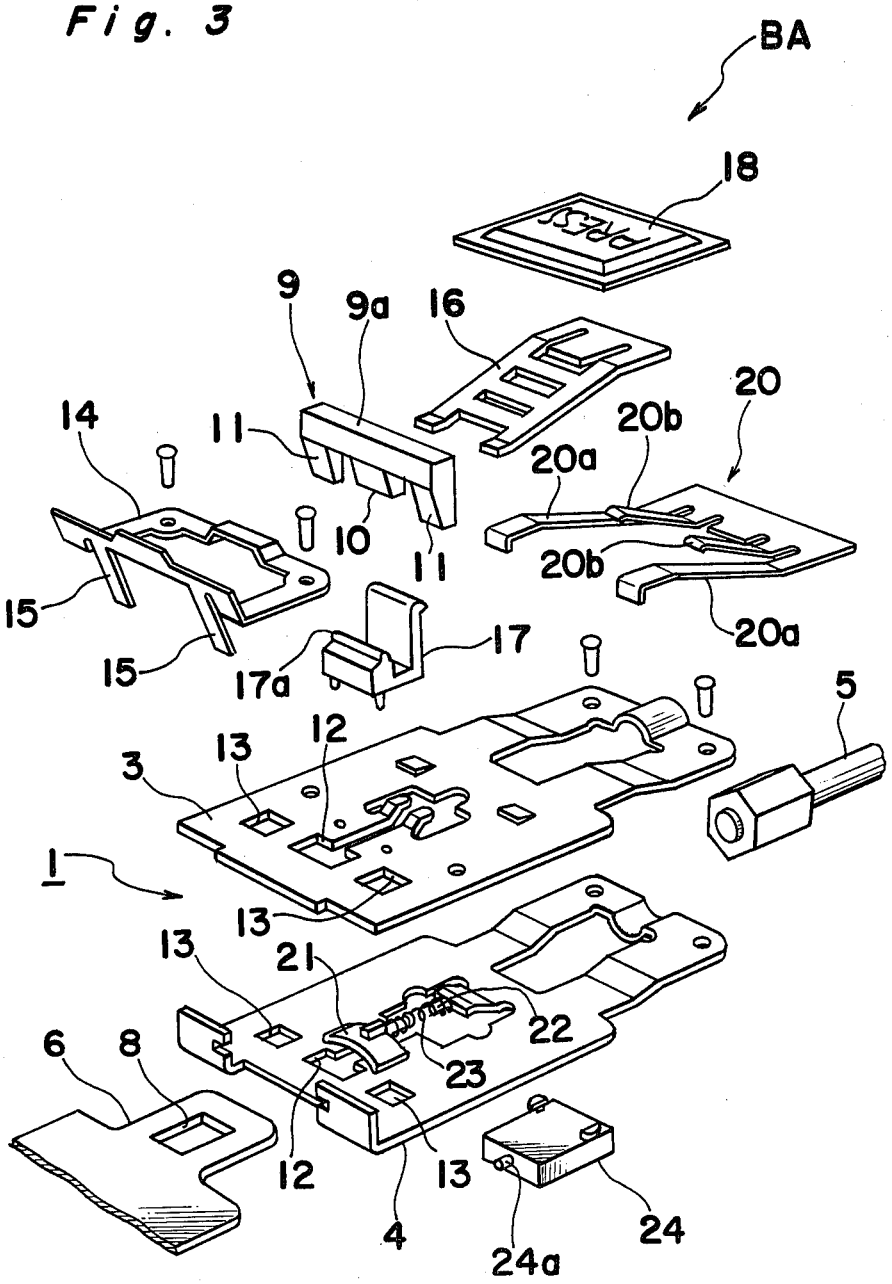
FIG. 3 is a perspective exploded view of the buckle arrangement of FIG. 1.

Referring now to the drawings, there is shown in FIGS. 1 through 3 a buckle arrangement BA for a seat belt according to one preferred embodiment of the present invention. The buckle arrangement BA generally includes a housing or cover member 2 defined by an upper cover 2*a* and a lower cover 2*b*, a frame 1 provided in the cover member 2 between the upper and lower covers 2*a* and 2*b*, and further including an upper plate 3 and a lower plate 4, and a locking member 9 movably disposed on the frame 1 for vertical displacement in a manner as described in greater detail later, while the frame 1 is arranged to receive at its one end, a tongue portion 6 which is connected to a seat belt coupled to a vehicle body (not shown) through an inlet 7 defined between the covers 2*a* and 2*b* of the cover member 2, and to be connected, at the other end thereof, to a wire 5 or the like also coupled to the vehicle body.

As is most clearly seen in FIG. 3, the tongue portion 6 has an engaging opening 8 of, for example, approximately rectangular configuration formed at its forward end portion, while the locking member 9 movably provided on the frame 1 for vertical movement has a base portion 9*a*, a lock portion 10 of a rectangular cross section extending downwardly from the central portion of the base portion 9*a*, and a pair of contact portions 11 of similar rectangular cross section also extending downwardly from opposite ends of the base portion 9*a*, with the surfaces of the contact portions 11 which are directed towards the inlet 7 of the cover member 2 being inclined to a certain extent, and thus, the locking member 9 is formed into approximately an E-shape on the whole. Each of the upper and lower plates 3 and 4 of the frame 1 has a generally rectangular insertion opening 12 formed therein for allowing the lock portion 10 of the locking member 9 to pass therethrough, and in the state where the tongue portion 6 of the seat belt is inserted into the frame 1, the lock portion 10 of the locking member 9 is also extended through the engaging opening 8 of the tongue portion 6 for locking of said tongue portion with respect to the frame 1 (FIG. 1). Furthermore, each of said upper and lower plates 3 and 4 is also provided with a pair of rectangular through-openings 13 formed at opposite sides of said insertion opening 12 for permitting the contact portions 11 of the locking member 9 to extend therethrough simultaneously with the insertion of the lock portion 10 into the insertion opening 12. The buckle arrangement BA further includes a retaining plate 14 produced, for example, by a rolled steel plate blanked by press work to be formed into a predetermined shape, and fixedly mounted on the upper palte 3 of the frame 1. The retaining plate 14 has a pair of retaining pieces 15 projecting slantwise downwardly from positions adjacent to opposite edges thereof, and extending through the through-openings 13 of the upper and lower plates 3 and 4 so as to be supported in two positions at the left side edges of the openings 13 in FIG. 3, while the locking member 9 to be moved downward for locking the tongue portion 6 inserted into the frame 1 has its contacting portions 11 contacting the corresponding surfaces of the retaining pieces 15. Since the retaining pieces 15 of the retaining plate 14 are gradually inclined upwardly towards the left in FIG. 3 at the sides of the surfaces thereof contacting the contacting portions 11 of the locking member 9, a force for moving the contact portions 11 upwardly, i.e. a slight component force in the direction for unlocking is exerted upon application of the force in the direction of withdrawal to the tongue portion 6. Moreover, since the contacting portions 11 of the locking member 9 are also slightly inclined at the surfaces thereof contacting the retaining pieces 15 of the retaining plate 14, the retaining pieces 15 and the contacting portions 11 are arranged to contact each other through their corresponding surfaces. Further included in the buckle arrangement BA is a rocking plate 16 as an operating member which is arranged to be pivotally supported by a support portion 17*a* of a support member 17 secured on the upper plate 3 for upward and downward rotation about said support portion 17*a*, and which is formed, at its one end, into a U-shape to be inserted below the base portion 9*a* of the locking member 9, and is attached, at its other end, with an operating plate or button 18 disposed in an operating opening 19 defined in the upper portion of the upper cover 2*a* (FIG. 1). On the upper plate 3 of the frame 1, there is mounted a plate spring 20 which has a pair of first spring pieces 20*a* extending slantwise upwardly from opposite ends thereof for normally urging the locking member 9 downwardly and another pair of second spring pieces 20*b* also extending slightwise upwardly from the portions between the first spring pieces 20*a* for normally urging the rotary plate 16 upwardly at its side attached to the operating button 18. In the space between the upper and lower plates 3 and 4 of the frame 1, there is provided a push out member 21 which is arranged to be movable between the plates 3 and 4 in the directions for insertion and withdrawal of the tongue portion 6, and is normally urged in the direction of withdrawal of the tongue portion 6 by a compression spring 23 disposed between said push out member 21 and a projection 22 formed in the lower plate 4 so as to be located under the locking member 9 in the state where the tongue portion 6 is not inserted and to be pushed by the end of the tongue portion 6 and depressed inwardly against the spring force of the compression spring 23 upon insertion of the tongue portion 6 into the frame 1. To the undersurface of the lower plate 4, a microswitch 24 is fixed which is arranged to be actuated through depression of an actuator 24*a* thereof by a depressing projection 21*a* provided at the undersurface of the push out member 21 when the tongue portion 6 is pressed into the frame 1, thereby to detect that the tongue portion 6 has been coupled to the frame 1, and interrupt the functioning, for example, of a seat belt attaching warning device (not shown).

By the above arrangement, when the tongue portion 6 is inserted into the frame 1 through the inlet 7 of the cover member 2 for coupling said tongue portion 6 with the frame 1, the distal end of the tongue portion 6 is first brought into contact with the push out member 21 located below the locking member 9. Thereafter, upon further insertion of the tongue portion 6, the push out member 21 is depressed against the biasing force of the compression spring 23, and the tongue portion 6 crawls under the locking member 9. When the lock portion 10 of the locking member 9 comes to confront the engaging opening 8 of the tongue portion 6, the locking member 9 is displaced downwardly by the spring force of the first spring pieces 20*a* of the plate spring 20, and the contact portions 11 of the locking member 9 extend through the through-openings 13 of the upper and lower plates 3 and 4, with the lock portion 10 of said locking member 9 being received into the engaging opening 8 of the tongue portion 6 for locking thereof. Meanwhile, owing to the depression of the push out member 21 against the spring force of the compression spring 23 by the insertion of the tongue portion 6 as described above, the microswitch 24 is actuated by the depressing projection 21*a* provided on the undersurface of the member 21. (FIG. 1). In the above state, even if the force is applied to the tongue portion 6 in the direction of withdrawal thereof, the peripheral edge of the engaging opening 8 of the tongue portion 6 is pressed against the lock portion 10 of the locking member 9, with the contact portions 11 of the locking member 9 contacting, under pressure, the retaining pieces 15 of the retaining plate 14 so as to be retained thereat, and thus, the tongue portion 6 never comes off the frame 1. More specifically, in the above state, the retaining pieces 15 of the retaining plate 14 against which the contact portions 11 of the locking member 9 are pressed as described above, are extended through the through-openings 13 of the upper and lower plates 3 and 4 and thus, the contact portions 11 are supported under pressure by the corresponding confronting edges of the openings 13 through the retaining pieces 15, while the lock portion 10 of the locking member 9 simultaneously extended through the insertion openings 12 of the upper and lower plates 3 and 4 is also supported under pressure by the corresponding confronting edges of said openings 12. Furthermore, in the above case, since the retaining pieces 15 are slightly inclined as described earlier, an upward force is applied to the contact portions 11 of the locking member 9, but since such a force is small, there is no possibility that the locking is released of itself due to upward displacement of the locking member 9 and consequent disengagement of the lock portion 10 from the engaging opening 8.

On the other hand, for releasing the tongue portion 6, the operating button 18 has only to be depressed by fingers, by which operation, the rocking plate 16 is rotated about the support portion 17*a* of the support member 17 against the urging force of the second spring pieces 20*b* of the plate spring 20 so as to pull up the locking member 9 for the withdrawal of the lock portion 10 thereof out of the engaging opening 8 of the tongue portion 6. Upon releasing of tongue portion 6 by the withdrawal of the lock portion 10 from the engaging opening 8 of the tongue portion 6, tongue portion 6 is pushed out of the frame 1 by the push out member 21 through the spring force of the compression spring 23 for disengagement from the frame 1.

Incidentally, during the lock releasing operation as described above, if the force in the direction of withdrawal is being applied to the tongue portion 6, the contact portions 11 of the locking member 9 contact, under strong pressure, the retaining pieces 15 of the retaining plate 14. However, since the retaining pieces 15 are inclined as described earlier, a component force in the upward direction, i.e. in the direction of unlocking is applied to said contact portions 11 so as to function as an auxiliary force for the tongue portion releasing, and thus, the tongue portion is readily released even when the operating button 18 is depressed by a small force. Moreover, since the contact surfaces between the retaining pieces 15 and contact portions 11 of the locking member 9 are of plate-like surfaces, for example, of rolled steel plate and thus, comparatively smooth, the frictional resistance thereat is generally small, and in cooperation with the presence of the component force arising from the inclination of the retaining pieces 15, releasing of the tongue portion 6 may be effected by only a small force.

Figure 4:
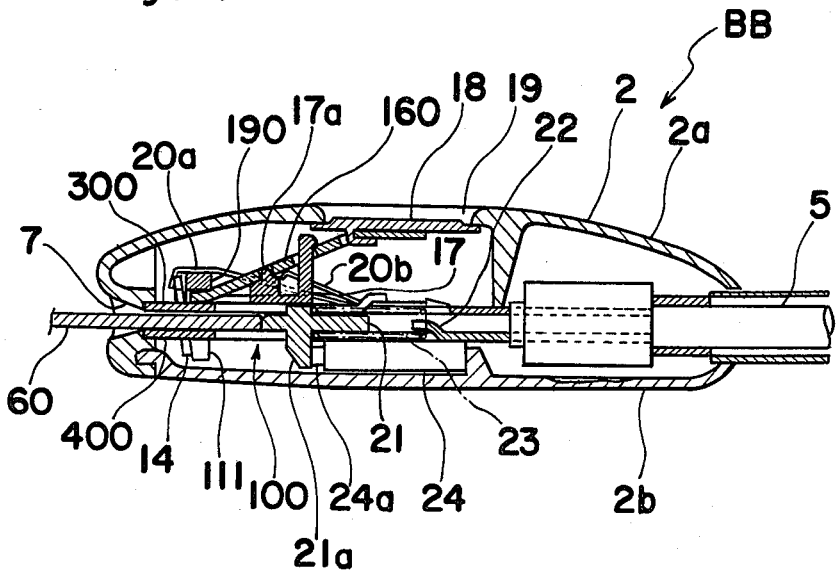
FIG. 4 is a view similar to FIG. 1, which particularly shows a modification thereof.
Figure 5:
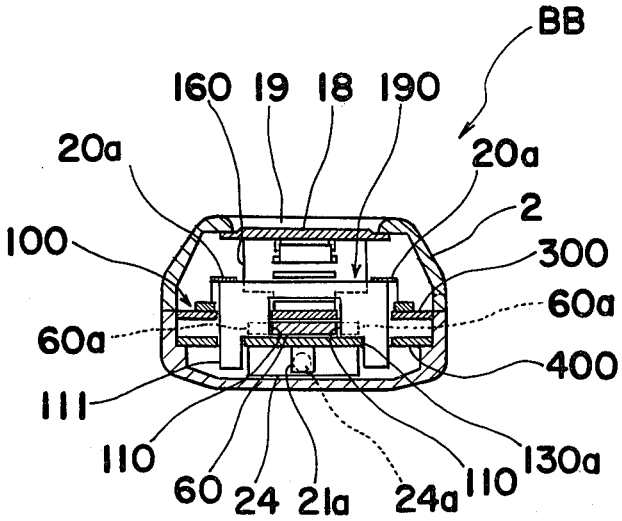
FIG. 5 is a front sectional view of the modified buckle arrangement of FIG. 4.
Figure 6:
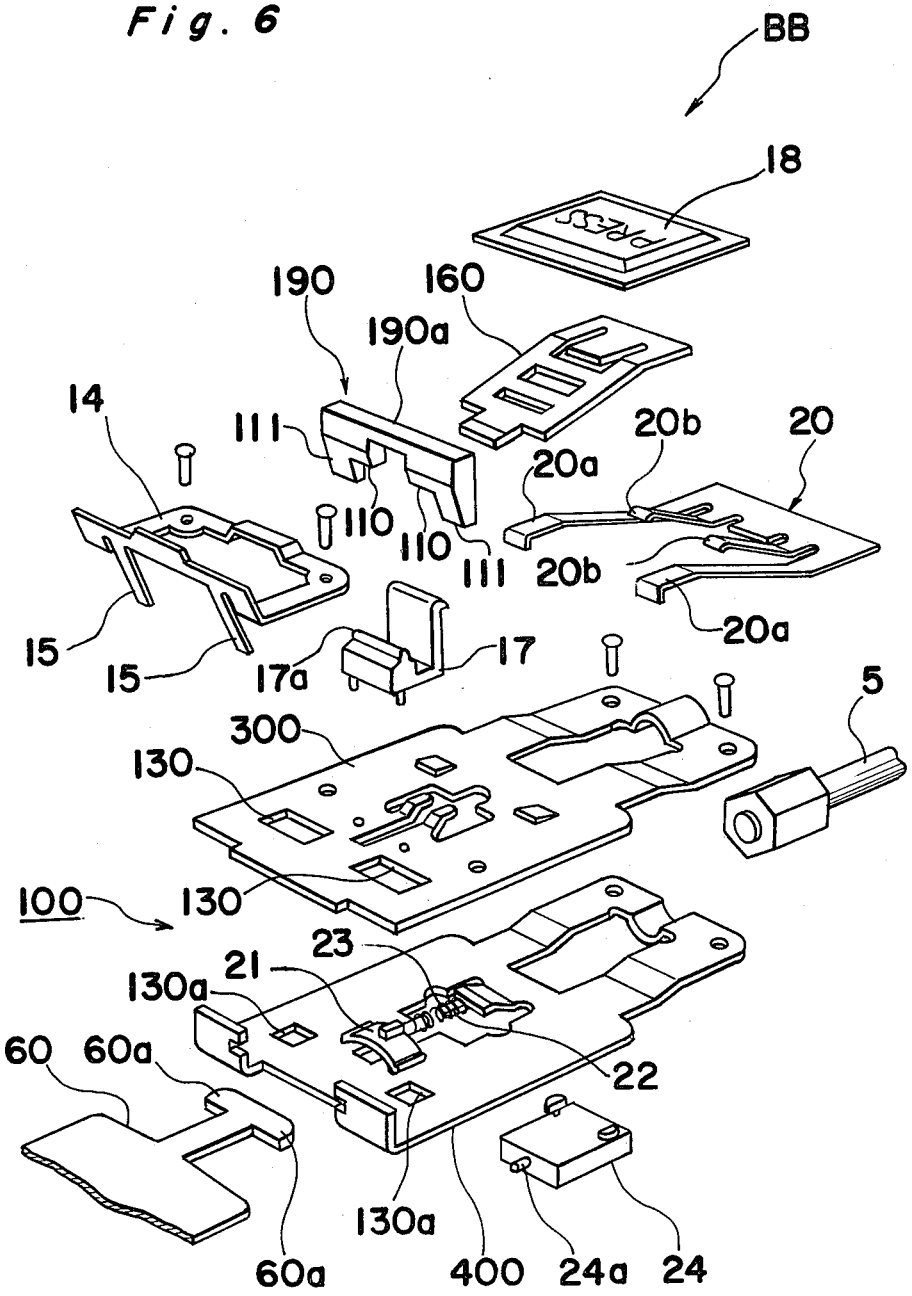
FIG. 6 is a perspective exploded view of the modified buckle arrangement of FIG. 4.

Referring now to FIGS. 4 to 6, there is shown a buckle arrangement BB according to a modification of the present invention.

In this modified arrangement of FIGS. 4 to 6, the tongue portion 6, frame 1 including the upper plate 3 and lower plate 4, locking member 9, rocking plate 16, etc. in the embodiment of FIGS. 1 to 3 are modified in the configurations thereof into the tongue portion 60, frame 100 having the upper plate 300 and lower plate 400, lock member 190, and rocking plate 160 as described hereinbelow except for the operating button 18, retaining plate 14, support member 17, spring plate 20, microswitch 24 which are generally indicated by the same reference numerals as those in FIGS. 1 to 3.

The modified buckle arrangement BB in FIGS. 4 through 6 generally includes the housing or cover member 2 defined by the upper cover 2*a* and the lower cover 2*b*, the frame 100 provided in the cover member 2 between the upper and lower covers 2*a* and 2*b*, and further including the upper plate 300 and lower plate 400, and the locking member 190 movably disposed in the frame 100 for vertical displacement, and the frame 100 is arranged to receive at its one end, the tongue portion 60 which is connected to the seat belt coupled to a vehicle body (not shown) through the inlet 7 defined between the covers 2*a* and 2*b* of the cover member 2, and to be connected, at the other end thereof, to the wire 5 and the like also coupled to the vehicle body.

As is shown in FIG. 6, the modified tongue portion 60 has a pair of engaging pieces 60*a* laterally extending from opposite side edges of the forward end portion thereof, while the locking member 190 movably provided on the frame 100 for vertical movement has a base portion 190*a*, a pair of contact portions 111 extending downwardly from opposite ends of the base portion 190*a* and lock portions 110 shorter in length than the contact portions 111 and formed in the inner side faces of said contact portions 111, with one surface of each of the contact portions 111 being inclined so as to provide a somewhat pointed configuration. The upper plate 300 is formed with a pair of insertion openings 130 adjacent to its one edge, while the lower plate 400 is also formed with a corresponding pair of through-openings 130*a* for allowing the contact portions 111 and lock portions 110 of the locking member 190 to simultaneously pass therethrough the contact portions 111 and with the through-openings 130*a* having sufficient size for receiving therein said contact portions 111, and in the state where the tongue portion 60 of the seat belt is inserted into the frame 100, the contact portions 111 of the locking member 190 are extended through the insertion openings 130 and the through-openings 130*a* of the upper and lower plates 300 and 400 respectively, with the lock portions 110 engaging the engaging pieces 60*a* of the tongue portions 60 for locking tongue portion 60 with respect to the frame 100. The retaining plate 14 produced, for example, by the rolled steel plate blanked by press work to be formed into the predetermined shape as described earlier, and fixedly mounted on the upper plate 300 of the frame 100, has the pair of retaining pieces 15 projecting slantwise downwardly from positions adjacent to opposite edges thereof, and extending through the openings 130 and 130*a* of the upper and lower plates 300 and 400 so as to be supported in two positions at the left side edges of the openings 130 and 130*a* in FIG. 6, while the locking member 190 for locking the tongue portion 60 inserted into the frame 100 has its contacting portions 111 contacting the corresponding surfaces of the retaining pieces 15. Since the retaining pieces 15 of the retaining plate 14 are gradually inclined upwardly towards the left in FIG. 6 at the sides of the surfaces thereof contacting the contacting portions 111 of the locking member 190 as described earlier, a force for moving the contact portions 111 upwardly, i.e. the slight component force in the direction for unlocking tongue portion 60 is exerted upon application of the force in the direction of withdrawal to the tongue portion 60.

The rotary plate 160 provided as an operating member is arranged to be pivotally supported by the support portion 17*a* of the support member 17 secured on the upper plate 300 for upward and downward rotation about said support portion 17*a*, and has its one end crawling under the base portion 190*a* of the locking member 190, and is attached at its other end, with the operating button 18 disposed in the operating opening 19 defined in the upper portion of the cover member 2*a* (FIG. 4). On the upper plate 300 of the frame 100, there is mounted the plate spring 20 which has the pair of first spring pieces 20*a* extending slantwise upwardly from opposite ends thereof for normally urging the locking member 190 downwardly and another pair of second spring pieces 20*b* also extending slightwise upwardly from the portions between the first spring pieces 20*a* for normally urging the rocking plate 160 upwardly at its side attached to the operating button 18 so as to position the button 18 in the operating opening 19. In the space between the upper and lower plates 300 and 400 of the frame 100, there is provided the push out member 21 which is arranged to be movable between the plates 300 and 400 in the directions for insertion and withdrawal of the tongue portion 60, and is normally urged in the direction of withdrawal of the tongue portion 60 by the compression spring 23 disposed between said push out member 21 and the projection 22 formed in the lower plate 400 so as to be located under the locking member 190 in the state where the tongue portion 60 is not inserted and to be pushed by the end of the tongue portion 60 and depressed inwardly against the spring force of the compression spring 23 upon insertion of the tongue portion 60 into the frame 100. To the undersurface of the lower plate 400, is fixed the microswitch 24 which is arranged to be actuated through depression of the actuator 24*a* thereof by the depressing projection 21*a* provided at the undersurface of the push out member 21 when the tongue portion 60 is pressed into the frame 100, thereby to detect that the tongue portion 60 has been coupled to the frame 100, and interrupt the functioning, for example, of the seat belt attaching warning device (not shown).

In the modified arrangement of FIGS. 4 to 6, when the tongue portion 60 is inserted into the frame 100 through the inlet 7 of the cover member 2 for coupling said tongue portion 60 with the frame 100, the distal end of the tongue portion 60 is first brought into contact with the push out member 21 located below the lock member 190. Thereafter, upon further insertion of the tongue portion 60, the push out member 21 is depressed against the biasing force of the compression spring 23, and the tongue portion 60 crawls under the locking member 190. When the engaging pieces 60*a* of the tongue portion 60 pass the lock portions 110 of the locking member 190, the locking member 190 is displaced downwardly to the locking position by the spring force of the first spring pieces 20*a* of the plate spring 20, and the lock portions 110 of the locking member 190 engage the engaging pieces 60*a* of the tongue portion 60, while simultaneously, the contact portions 111 of the locking member 190 are received into the insertion openings 130 and through openings 130*a* of the upper and lower plates 300 and 400, with the tongue portion 60 being thus locked. Meanwhile, owing to the depression of the push out member 21 against the spring force of the compression spring 23 by the insertion of the tongue portion 60 as described above, the microswitch 24 is actuated by the depressing projection 21*a* provided on the undersurface of the member 21 simultaneously with the locking of the tongue portion 60 (FIG. 4). In the above state, even if the force is applied to the tongue portion 60 in the direction of withdrawal thereof, the end edges of the engaging portions 60*a* of the tongue portion 60 come into contact with the lock portions 110 of the locking member 190, with the contact portions 111 of said lock member 190 contacting the retaining pieces 15 of the retaining plate 14 so as to be retained thereat, and thus, the tongue portion 60 never comes off the frame 100. More specifically, in the above state, the retaining pieces 15 of the retaining plate 14 against which the contact portions 11 of the locking member 190 are pressed as described above, are extended through the through-openings 130 of the upper and lower plates 300 and 400 and thus, the contact portions 111 are supported under pressure by the corresponding confronting edges of the openings 130 through the retaining pieces 15, with the lock portions 110 of the locking member 190 simultaneously engaging the engaging pieces 60*a* of the tongue portion 60. Furthermore, in the above case, since the retaining pieces 15 are slightly inclined as described earlier, the upward force is applied to the contact portions 111 of the locking member 190, but since such a force is small, there is no possibility that the tongue portion 60 is released of itself due to upward displacement of the locking member 190 and consequent disengagement of the lock portions 110 from the engaging pieces 60*a*.

On the other hand, for releasing the tongue portion 60, the operating button 18 has only to be depressed by fingers, by which operation, the rocking plate 160 is rotated about the support portion 17*a* of the support member 17 against the urging force of the second spring pieces 20*b* of the plate spring 20 so as to pull up the base portion 190*a* of the locking member 190 for the disengagement of the lock portions 110 from the engaging pieces 60*a* of the tongue portion 60. Upon unlocking tongue portion 60 from locking member tongue portion 60 is pushed out of the frame 100 by the push out member 21 through the spring force of the compression spring 23 for disengagement from the frame 100.

Incidentally, during the lock releasing operation as described above, if the force in the direction of withdrawal is being applied to the tongue portion 60, the contact portions 111 of the locking member 190 contact, under strong pressure, the retaining pieces 15 of the retaining plate 14. However, since the retaining pieces 15 are inclined to a certain extent as described earlier, the component force in the upward direction, i.e. in the direction of releasing the locking is applied to said contact portions 111 so as to function as the auxiliary force for the lock releasing, and therefore, the tongue portion is readily released even when the operating button 18 is depressed by a small force. Moreover, since the contact surfaces between the retaining pieces 15 and lock portions 111 of the locking member 190 are of plate surfaces, for example, of rolled steel plates and thus, comparatively smooth, the frictional resistance between the retaining pieces 15 and lock portions 111 is generally small, and in cooperation with the presence of the component force arising from the inclination of the retaining pieces 15, the unlocking may be effected by a small force.

Since other constructions, functions and effects of the modified buckle arrangement BB of FIGS. 4 through 6 are generally similar to those of the buckle arrangement BA of FIGS. 1 to 3, detailed description thereof is abbreviated here for brevity.

Figure 7:
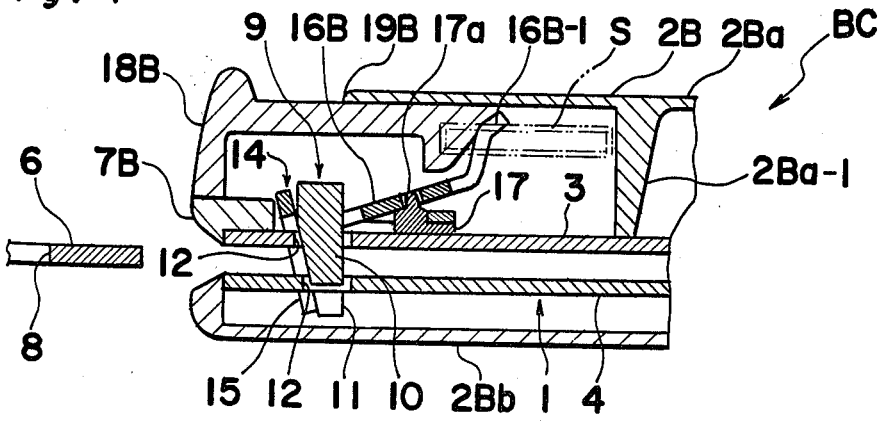
FIG. 7 is a fragmentary side sectional view shown another modification of the arrangement of FIG. 1, and FIGS. 8 and 9 are fragmentary perspective views showing further modifications of retaining portions employed in the arrangement of FIG. 1.

Referring now to FIG. 7 showing a main portion of a buckle arrangement according to another modification of the arrangement of FIGS. 1 to 3, with like parts being designated by like reference numerals, the modified buckle arrangement BC includes the cover member 2B having the upper cover 2B*a* and lower cover 2B*b* between which the inlet 7B for the tongue portion 6 of the seat belt is formed, the frame 1 provided between the upper and lower covers 2B*a* and 2B*b* and further including the upper and lower plates 3 and 4, the operating button 18B slidably provided, above the upper plate 3, in the opening 19B formed in the upper cover 2B*a* in the position above the inlet 7B for the tongue portion 6, and the locking member 9 movably disposed on the frame 1 for vertical movement in the similar manner as in the arrangement of FIGS. 1 through 3. The operating button 18B is normally urged leftward in FIG. 7 by a compression spring S connected between a spring receiving portion 2B*a*-1 provided in the inner lower portion of the cover 2B*a* and said operating button 18B. There is also provided the rocking plate 16B having its one end remote from the locking member 9, bent upwards to form a receiving portion 16B-1 which contacts the corresponding end of the operating button 18B, and pivotally supported by the support portion 17*a* of the support member 17 for rotation about the support portion 17*a*. Since other constructions and functions of the modified buckle arrangement BC of FIG. 7 are generally similar to those of the arrangement of FIGS. 1 to 3, detailed description thereof is omitted here for brevity, with like parts being designated by like reference numerals.

In the above modified arrangement of FIG. 7, when the tongue portion 6 is inserted into the frame 1, said tongue portion is locked in the similar manner as in the embodiment of FIGS. 1 to 3, and thereafter, upon depression of the operating button 18B into the inner portion of the upper cover 2B*a* against the urging force of the spring S, the receiving portion 16B-1 of the rocking plate 16B is pressed down by the corresponding end of the operation button 18B, with consequent rotation of the rocking plate 16B and upward movement of the locking member 9, and as a result, the lock portion 10 of the locking member 9 is disengaged from engaging opening 8 of the tongue portion 6 for unlocking. Meanwhile, even when the above lock releasing is effected in the state where the force in the direction of withdrawal of the tongue portion 6 is applied thereto, the locking member 9 is smoothly moved upwards in exactly the same manner as in the embodiment of FIGS. 1 to 3, and thus, the lock releasing may be effected by an extremely small operating force.

Figure 8:
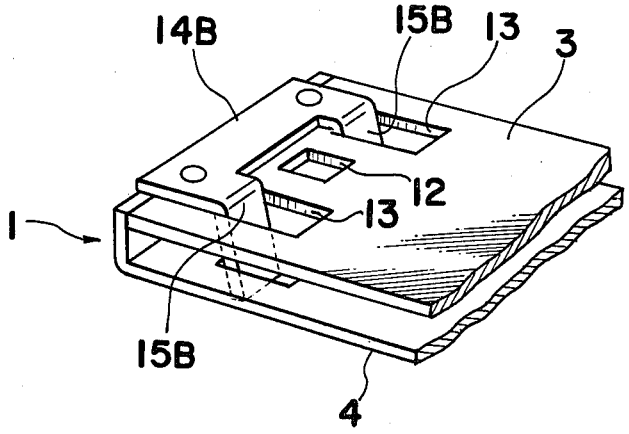
Figure 9:
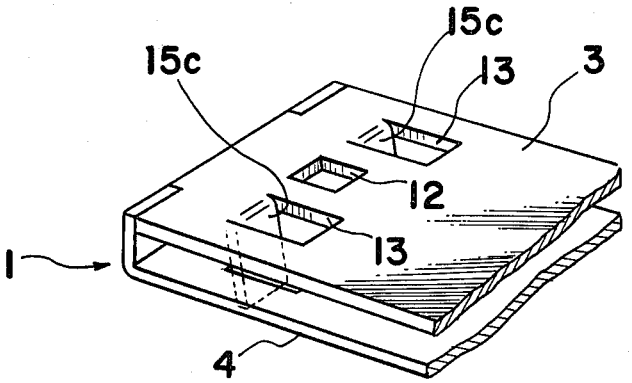

It should be noted here that the retaining means according to the present invention is not limited to the retaining plate 14 described with reference to FIGS. 1 to 3, or FIGS. 4 to 6, but may further be modified, for example, to a retaining plate 14B formed by a plate material of a generally U-shape, with its portions which extend in a parallel relation from the opposite ends thereof being bent at a suitable angle to provide retaining pieces 15B as shown in FIG. 8. Similarly, the retaining plate 14 may be replaced by retaining pieces 15*c* formed during blanking of the through-openings 13 of the upper plate 3 by press work without completely blanking said openings for simultaneous formation of the openings 13 and retaining pieces 15*c* extending from side edges of openings 13. In short, it is sufficient for the purpose, if the retaining pieces are formed into plate-like shape, with the surfaces of the retaining pieces at the side thereof for contacting the locking member being so inclined as to produce the component force on the locking member in the direction of unlocking, when the force in the direction of withdrawal is applied to the tongue portion.

As is clear from the foregoing description, the present invention is characterized in that the retaining portions provided on the frame for retaining the locking member are formed into the plate-like configuration, while the surfaces of the retaining portions at the side thereof for contacting the locking member are inclined so that the component force is produced on the locking member in the direction of unlocking upon application of the force in the direction of withdrawal to the tongue portion, and thus, according to the buckle arrangements for seat belts of the invention, the unlocking may be effected by a small operating force, even where the component force in the direction of withdrawal is being applied to the tongue portion.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. A buckle arrangement for a seat belt comprising:

a frame member;

a tongue portion having an inserting end, insertable into said frame member in an insertion direction and withdrawable from said frame member in a withdrawal direction;

a locking member having contact portions, movably disposed on said frame member for movement into a locking position in which said tongue portion is locked in said frame member upon insertion of said tongue portion into said frame member, and for movement from said locking position in a direction of unlocking to unlock said tongue portion from said frame member; said tongue portion having engaging means, formed at said inserting end, for selective engagement of said tongue portion with and disengagement of said tongue portion form said locking member;

means for moving said locking member form said locking position in said direction of unlocking; and a retaining plate having a plate-like surface, provided on said frame member for retaining said locking member in said locking position, said retaining plate having portions inclined to said plate-like surface for contact with said contact portions of said locking member, such that said retaining plate exerts a component force in said withdrawal direction on said tongue portion.

2. A buckle arrangement as claimed in claim 1, wherein said locking member includes a lock portion, and said engaging means comprises an engaging opening formed in said inserting end of said tongue portion for selective engagement with and disengagement from said lock portion.

3. A buckle arrangement as claimed in claim 1, wherein said locking member includes a lock portion, and said engaging means comprises a pair of engaging projections laterally extending from said inserting end of said tongue portion for selective engagement with and disengagement from lock portions.

4. A buckle arrangement as in claim 1 wherein said frame member has edge portions defining through holes in said frame member for receiving therein said contact portions being formed on corresponding ones of said edge portions so as to contact said contact portions when said contact portions are received in said through holes.

* * * * *